US011011122B2

(12) United States Patent
Ophir et al.

(10) Patent No.: US 11,011,122 B2
(45) Date of Patent: May 18, 2021

(54) LIQUID CRYSTAL DISPLAY HAVING A ROLLING BACKLIGHT

(71) Applicant: ELBIT SYSTEMS LTD., Haifa (IL)

(72) Inventors: Yoav Ophir, Zichron Yaacov (IL); Gil Benesh, Kiryat Tivon (IL)

(73) Assignee: Elbit Systems Ltd., Haifa (IL)

( * ) Notice: Subject to any disclaimer, the term of this patent is extended or adjusted under 35 U.S.C. 154(b) by 0 days.

(21) Appl. No.: 14/917,959

(22) PCT Filed: Sep. 10, 2014

(86) PCT No.: PCT/IL2014/050805
§ 371 (c)(1),
(2) Date: Mar. 10, 2016

(87) PCT Pub. No.: WO2015/036996
PCT Pub. Date: Mar. 19, 2015

(65) Prior Publication Data
US 2016/0225328 A1 Aug. 4, 2016

(30) Foreign Application Priority Data
Sep. 10, 2013 (IL) ..... 228331

(51) Int. Cl.
*G09G 3/34* (2006.01)
*G09G 3/36* (2006.01)

(52) U.S. Cl.
CPC ..... *G09G 3/3426* (2013.01); *G09G 3/3666* (2013.01); *G09G 3/3688* (2013.01); *G09G 2300/023* (2013.01); *G09G 2300/0809* (2013.01); *G09G 2310/024* (2013.01); *G09G 2320/0646* (2013.01)

(58) Field of Classification Search
CPC ... G09G 3/3426; G09G 3/3666; G09G 3/3688
See application file for complete search history.

(56) References Cited

U.S. PATENT DOCUMENTS

2005/0007389 A1 1/2005 Kumamoto et al.
2007/0176883 A1* 8/2007 Hsu ..... G09G 3/342 345/102

(Continued)

OTHER PUBLICATIONS

Search Report of PCT Application No. PCT/IL2014/050805 dated Nov. 6, 2014.

(Continued)

*Primary Examiner* — Alexander Eisen
*Assistant Examiner* — Cory A Almeida
(74) *Attorney, Agent, or Firm* — Pearl Cohen Zedek Latzer Baratz LLP

(57) ABSTRACT

A liquid crystal display (LCD) that may include: a plurality of transistors groups forming a pixel array of said LCD, wherein the transistors groups are independently controllable; a plurality of backlight units, forming a backlight surface of said LCD, wherein the backlight units are independently controllable; a data refresh module configured to periodically refresh data at said groups of transistors, at a specified order, over a refresh cycle time; and a backlight control module configured to periodically dim the backlight units at said specified order over a backlight cycle time which is substantially shorter than the refresh cycle time.

12 Claims, 4 Drawing Sheets

(56) References Cited

U.S. PATENT DOCUMENTS

| | | | | |
|---|---|---|---|---|
| 2009/0135108 | A1 | 5/2009 | Lindfors et al. | |
| 2009/0322800 | A1* | 12/2009 | Atkins | G09G 3/3413 345/690 |
| 2010/0123839 | A1* | 5/2010 | Lu | G02B 27/2264 349/15 |
| 2010/0283938 | A1 | 11/2010 | Chou | |
| 2011/0205251 | A1 | 8/2011 | Auld | |
| 2011/0205625 | A1 | 8/2011 | Auld | |
| 2011/0267297 | A1* | 11/2011 | Yamazaki | G06F 1/3265 345/173 |
| 2012/0113498 | A1 | 5/2012 | Margerm et al. | |

OTHER PUBLICATIONS

Extended European Search Report for Application No. 14843537.3, dated Mar. 21, 2017.
Office Action for EP Patent Application No. 14843537.3, dated Nov. 12, 2020.

* cited by examiner

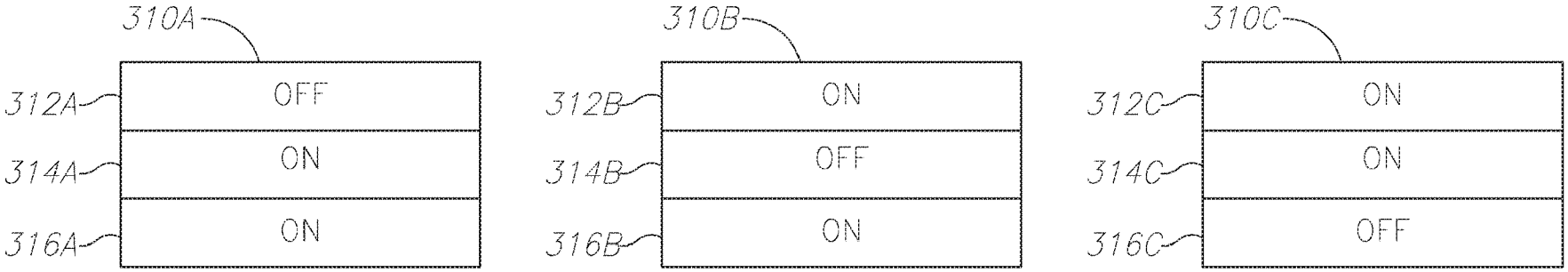
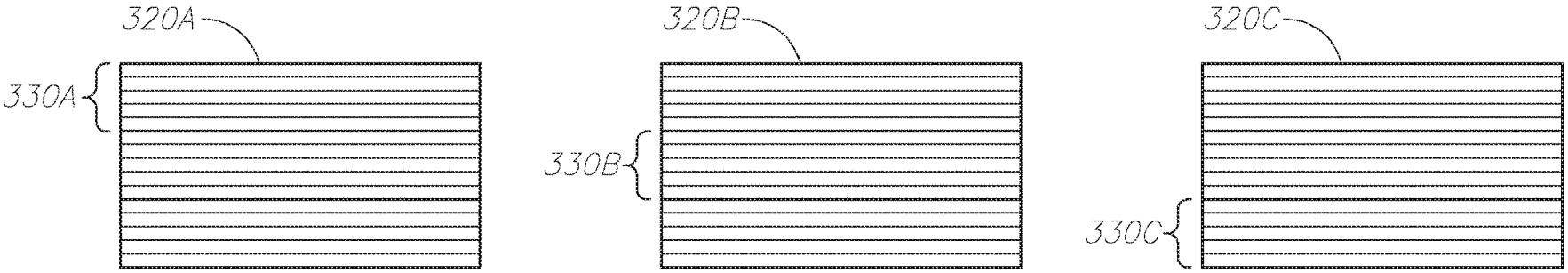
Figure 3A
Figure 3B
Figure 3C

LIQUID CRYSTAL DISPLAY HAVING A ROLLING BACKLIGHT

CROSS-REFERENCE TO RELATED APPLICATIONS

This application is a National Phase Application of PCT International Application No. PCT/IL2014/050805, International Filing Date Sep. 10, 2014, entitled: "LIQUID CRYSTAL DISPLAY HAVING A ROLLING BACKLIGHT", published on Mar. 19, 2015 as International Patent Application Publication No. WO 2015/036996, claiming priority of Israel Patent Application No. 228331, filed Sep. 10, 2013, all of which hereby incorporated by reference in their entirety.

FIELD OF THE INVENTION

The present invention relates to liquid crystal displays and more particularly, to such displays with controllable backlight.

BACKGROUND OF THE INVENTION

Typically, a liquid crystal display (LCD) includes a backlight surface that is configured to produce the backlight that passes through the pixel array which is usually comprised of transistors such as thin film transistors (TFT) and the like. While most LCDs utilize backlight modules that are always being uniformly lit as a single unit, some backlight units are known to be partially lit or locally dimmed, usually based on the data being inputted to the pixels array.

One motivation for local dimming is a case in which a specified region of the display is required to present a very dark (or black) scene, ambiance, or object. By dimming specific backlight units, better representation of the very dark data is achieved. One characteristic of the aforementioned solution is that it is clearly data-aware and the local dimming is carried out based on values of data applied to the pixels upon refreshing.

One known artifact in LCDs is that a backlight which illuminates beyond a specified intensity might photo activate pixel transistors as they as being refreshed. The photo activation may lead to transistors saturation and undesirable results affecting the quality of the image presented.

SUMMARY OF THE INVENTION

According to some embodiments of the present invention, a liquid crystal display (LCD) with controllable backlight is provided herein. The LCD may include a plurality of transistors groups forming a pixel array of said LCD. The transistors groups may be independently controllable. The LCD may further include a plurality of backlight units, forming a backlight surface of said LCD and a data refresh module configured to periodically refresh data at the groups of transistors, at a specified order, over time. The LCD may further include a backlight control module configured to dim the backlight units that spatially overlap one or more of the transistor groups whenever the data at said transistor groups is being refreshed by the data refresh module.

According to another embodiment, the LCD may include: a plurality of transistors groups forming a pixel array of said LCD, wherein the transistors groups are independently controllable; a plurality of backlight units, forming a backlight surface of said LCD, wherein the backlight units are independently controllable; a data refresh module configured to periodically refresh data at said groups of transistors, at a specified order, over a refresh cycle time; and a backlight control module configured to periodically dim the backlight units at said specified order over a backlight cycle time which is substantially shorter than the refresh cycle time.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings:

FIGS. 3A-3C are schematic diagrams illustrating several aspects in accordance with some embodiments of the present invention.

Figure 1:
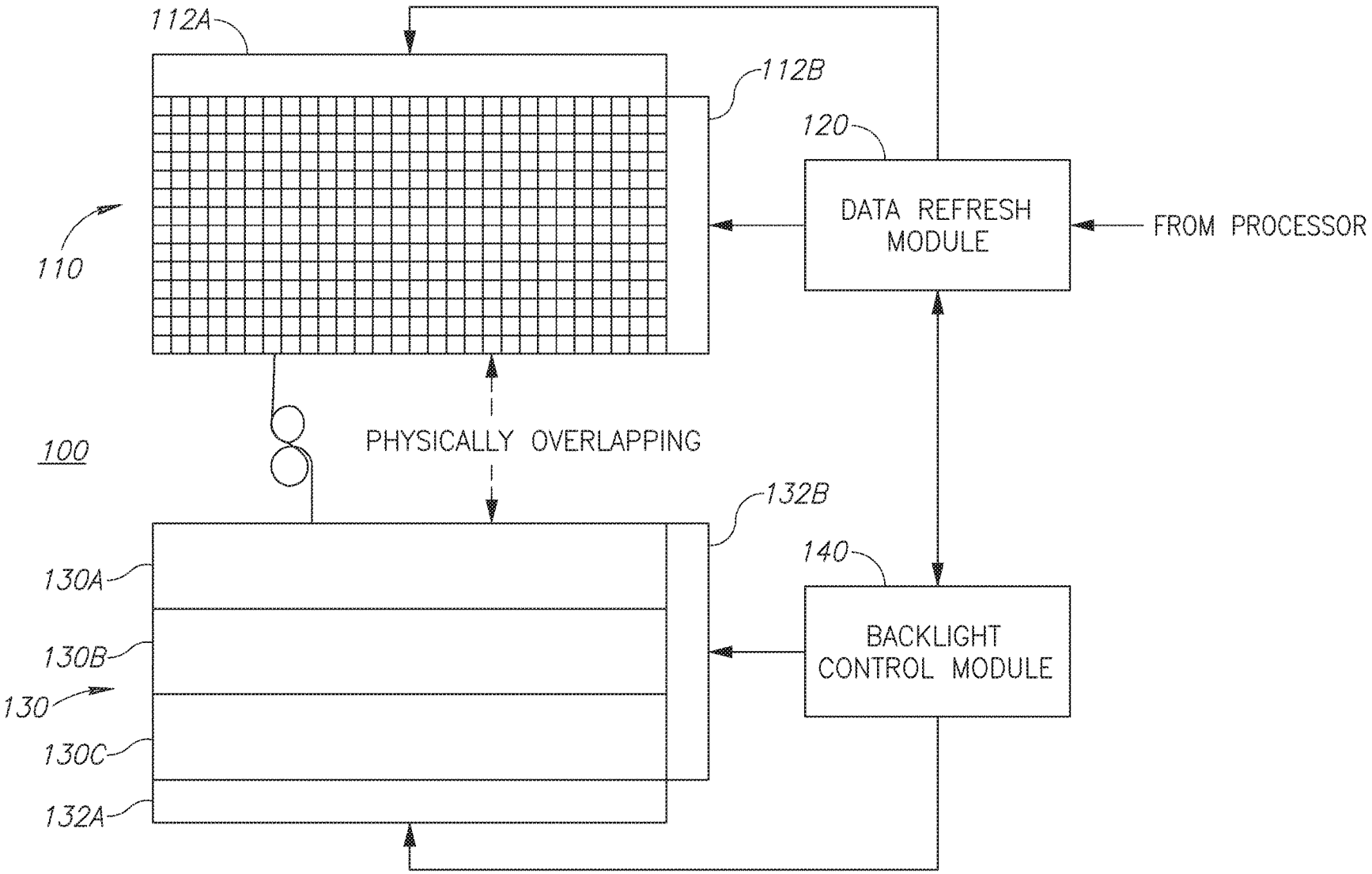
FIG. 1 is a schematic diagram illustrating a system in accordance with some embodiments of the present invention.

The drawings together with the following detailed description make apparent to those skilled in the art how the invention may be embodied in practice.

DETAILED DESCRIPTION OF THE INVENTION

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a schematic diagram illustrating a system in accordance with some embodiments of the present invention. Embodiments of the present invention provide a liquid crystal display (LCD) 100 which may include a plurality of transistors groups forming a pixel array 110 of LCD 100. The transistors groups may be independently controllable, possibly by drivers 112A and 112B. The LCD may further include a plurality of backlight units such as 130A, 130B, and 130C, forming a backlight surface 130 of LCD 100, being independently controllable, possibly via drivers 132A and 132B. LCD 100 may further include a data refresh module 120 electrically connected to pixel array 110 via drivers 112A and 112B and configured to periodically refresh data at the groups of transistors, at a specified order, over time. Additionally to the data refresh module whose functionality is present in any currently available electronic display, LCD 100 may further include a backlight control module 140 electrically connected to backlight surface 130 via drivers 132A and 132B and configured to dim backlight units such as 130A, 130B, and 130C that spatially overlap one or more of the transistor groups whenever the data at the transistor groups is being refreshed by data refresh module 120. Advantageously, the likelihood of undesirable photo activation is reduced since the intensity of the backlight that reaches the transistors as they are being updated is reduced.

According to some embodiments of the present invention, the aforementioned data refreshing is carried out in a predefined refreshing pattern which sets out an order of refreshing the pixels. Similarly, the aforementioned dimming is carried out in a predefined dimming pattern which sets out an order of dimming the backlight units. Backlight control module 140 may be configured in such a way that the refreshing pattern and the dimming pattern are synchronized so that the dimming pattern follows the refreshing pattern.

According to some embodiments of the present invention, the dimming may include any decrease in the intensity of the light emitted from the dimmed backlight units up to a full switch off. In some alternatives, the dimming may be carried out independently at variable levels so that some units may be dimmed more or less than others. Additionally, at least one of the transistors groups may include one or more transistors.

Figure 2:
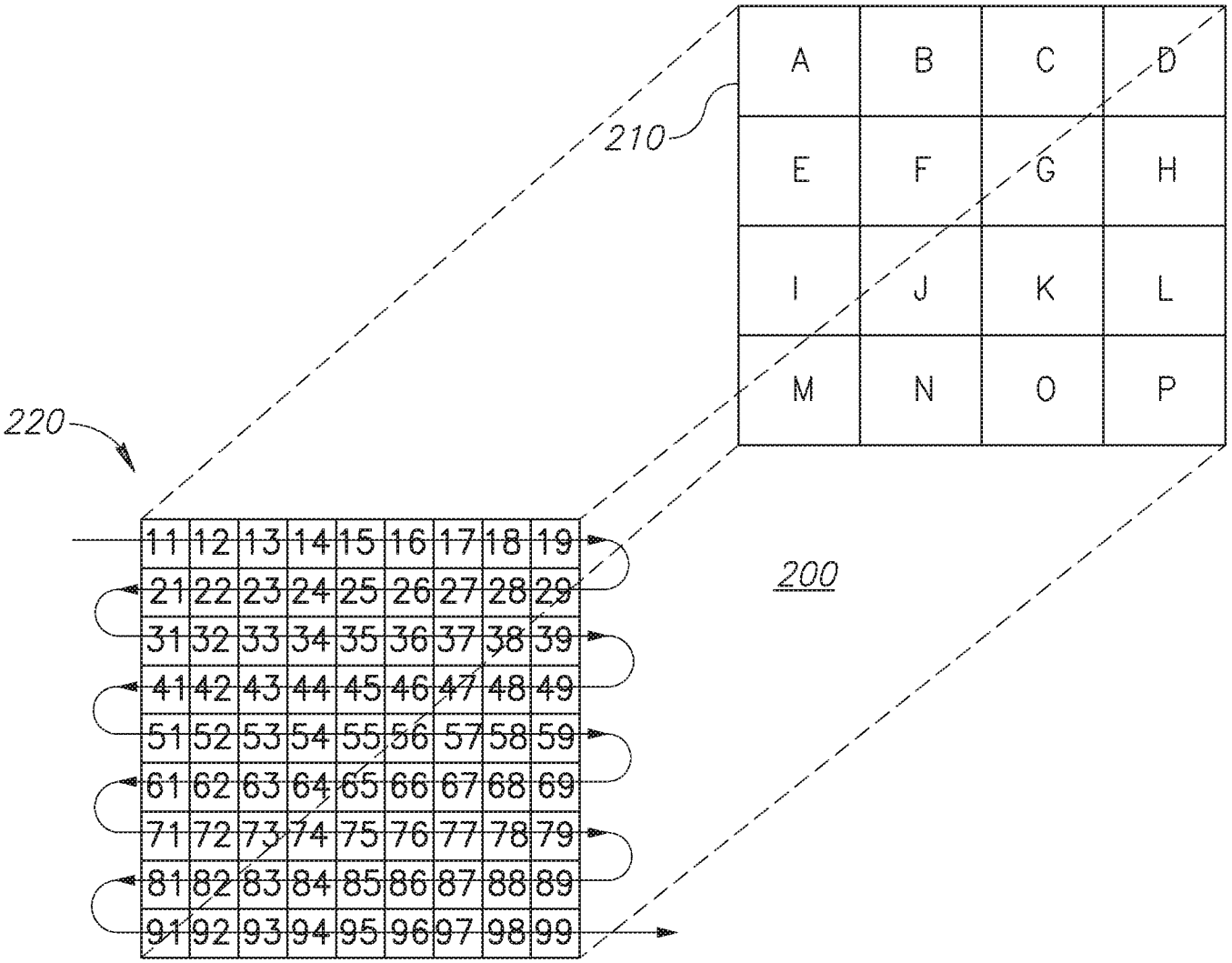
FIG. 2 is a schematic diagram illustrating an aspect in accordance with embodiments of the present invention.

FIG. 2 is a schematic diagram illustrating an aspect in accordance with embodiments of the present invention. LCD layout 200 shows how pixel array 220 may relate to the overlapping backlight module 210. It is noted that the proportion and numbers are for illustration purposes only and should not be regarded as limiting. Backlight module 210 is shown here to have A-P units in a 4×4 configuration (16 all in all) whereas pixel array 220 is illustrated as having 11-99 pixels in a 9×9 configuration (81 all in all). The pixels and the backlight units are interrelated in such a way that some of the pixels are mapped to specific backlight units while other pixels are mapped to other backlight units. In operation, as the pixels are being updated (possibly as shown by the rolling direction of the arrow) the backlight units may be dimmed correspondingly. For example, pixels in rows 11-19 and 21-29 may be associated with backlight unites in row A-D and so in operation, whenever data is updated in pixels in rows 11-19 and 21-29, backlight units A-D are dimmed. Similarly, whenever pixels 31-39 and 41-49 are being updated, backlight unit E-H are being dimmed and go forth until all pixels are updated and another refresh cycle begins. In a typical case where the pixels are being updated in a rolling pattern (as depicted), the backlight units are also "rolling" in their local dimming but it is understood that any dimming pattern is possible as long as it follows the refresh pattern of the pixels.

According to some embodiments, the data refresh module may be configured to periodically refresh data at said groups of transistors, at a specified order, over a refresh cycle time. The backlight control module may be configured to periodically dim the backlight units at the specified order as the refresh module but over a backlight cycle time which is substantially shorter than the refresh cycle time. This way, the duration of light that passes through the group of transistors is reduced for each cycle (although the overall luminance is not decreased). This feature is advantageous specifically for moving viewer, such as when the LCD is a micro display integrated within a head mounted display (HMD). With moving viewers, since the refresh rate of the data is usually limited for LCDs, using a higher (e.g. 3 times to 10 times higher) backlight dimming rate, eliminates or reduces the risk of smearing the projected image over the retina of the viewer's eyes. Thus, for example, the dim cycle of backlight units A, B . . . O, P can be carried out in one third of the time that takes to refresh the data along the refresh cycle of transistor groups 11, 12 . . . 98, and 99.

According to some embodiments, the backlight control module may be further synchronized with the data refresh module so as to dim backlight units whenever transistors groups that are affected by the light of the backlight units are being refreshed. Transistors may be affected by light even if the backlight is not exactly parallel to them and so measurements need to be carried out id phot excitation needs to be avoided at the transistors by stray light of the backlight at the time of data refresh.

According to some embodiments, the backlight control module may be further configured to selectively dim backlight units that are located along borders of the LCD. Advantageously Selectively dimming backlight units A, B, C, D, H, L, P, O, N, M, I, and E being on the border will assist in a case of dark video data to reduce the undesirable haze that may occur where "true black" cannot be achieved due to the nature of LCDs.

FIGS. 3A-3C are schematic diagrams illustrating an aspect in accordance with some embodiments of the present invention. As illustrated, 310A, 310B and 310C show different stages of the backlight unit along the refresh cycle of the pixels, whereas 330A, 330B, and 330C show corresponding stages for the pixel array. Each stage shows which backlight units are dimmed (or OFF) when the pixels are refreshed. For example, in 310A, backlight unit 312A is dimmed and 314A and 316A are turned on since pixels 330A are being refreshed. In 310B, backlight unit 314B is dimmed and 312B and 316B are turned on since pixels 330B are being refreshed. Finally, in 310C, backlight unit 316C is dimmed and 312C and 314C are turned on since pixels 330C are being refreshed. The number of transistors groups being M and the number of backlight units N is typical when N<M. Additionally, the groups of transistors may be arranged in an array of rows and columns and wherein each row is associated with a subset of backlight units, wherein the associated backlight units are turned off whenever the respective row is being refreshed.

Figure 4:
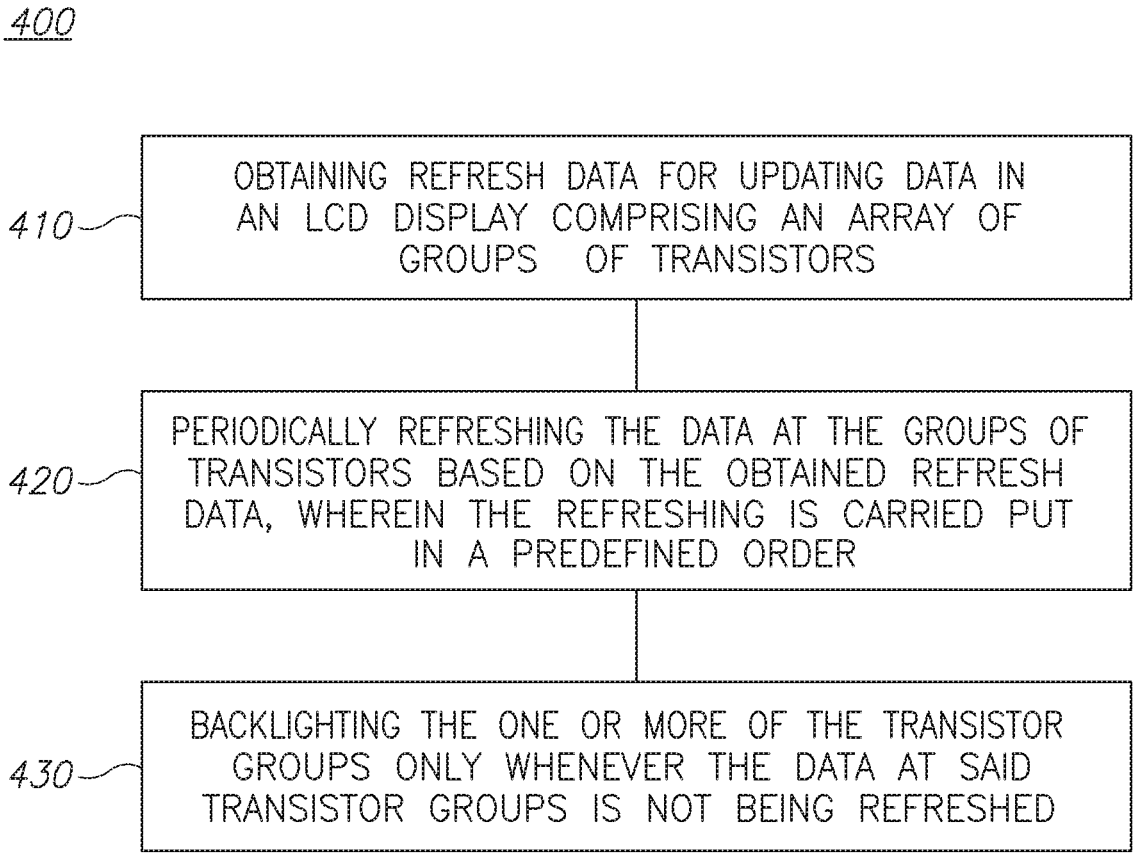
FIG. 4 is a high level flowchart illustrating another aspect in accordance with some embodiments of the present invention.

FIG. 4 is a high level flowchart illustrating another aspect in accordance with embodiments of the present invention. Method for backlighting a liquid crystal display (LCD) 400 may include the following stages: obtaining refresh data for updating data in an LCD display comprising an array of groups of transistors 410; periodically refreshing data at the groups of transistors based on the obtained refresh data, wherein the refreshing is carried out in a predefined order 420; and backlighting the one or more of the transistor groups only whenever the data at said transistor groups is not being refreshed 430.

In another embodiment, the method may include the following stages: independently controlling a plurality of transistors groups forming a pixel array of said LCD; independently controlling a plurality of backlight units, forming together a backlight surface of said LCD; periodically refreshing data at said groups of transistors, at a specified order, over time; and dimming the backlight units that spatially overlap one or more of the transistors groups whenever the data at said transistor groups is being refreshed by said data refresh module.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

While the invention has been described with respect to a limited number of embodiments, these should not be construed as limitations on the scope of the invention, but rather as exemplifications of some of the preferred embodiments. Other possible variations, modifications, and applications are also within the scope of the invention.

The invention claimed is:

1. A system for reducing photo-activation of transistors in a liquid crystal display (LCD), the system comprising:

a plurality of groups of transistors arranged in rows and columns which form a pixel array of said LCD;

a plurality of backlight units arranged in rows and columns which form a backlight panel of said LCD, wherein the backlight units are independently controllable;

a data refresh module configured to periodically refresh data at the groups of transistors, wherein the data is being refreshed at a specified data refresh order and at a specified refresh rate over a specified period; and a backlight control module configured to periodically dim the backlight units at said specified data refresh order and at a specified dimming rate over said specified period, to backlight the one or more of the transistor groups only whenever the data at said transistor groups is not being refreshed, wherein the LCD is a micro display integrated within a head mounted display (HMD), and operating in a dim-to-refresh ratio in which the specified backlight dimming rate is between 3 times to 10 times higher than the specified refresh rate, and wherein said operating in the dim-to-refresh ratio eliminates a smearing of an image projected from the micro display over a retina of an eye of a viewer wearing the HMD, whenever a head of the viewer is moving, wherein the dimming is carried out independently at variable levels so that some of the backlight units are dimmed more or less than others during said specified period.

2. The system according to claim 1, wherein the backlight control module is further configured to selectively dim backlight units that are located along borders of the LCD.

3. The system according to claim 1, wherein the data refreshing is carried out in a predefined refreshing pattern which sets out an order of refreshing the pixels and wherein the dimming is carried out in a predefined dimming pattern which sets out an order of dimming the backlight units, and wherein the refreshing pattern and the dimming pattern are synchronized so that the dimming pattern follows the refreshing pattern.

4. The system according to claim 1, wherein the dimming comprises switching off at least one backlight unit.

5. The system according to claim 1, wherein at least one of the transistors groups include one or more transistors.

6. The system according to claim 1, wherein said LCD comprises M transistors groups and N backlight units and wherein $N<M$.

7. A method of reducing photo-activation of transistors in a liquid crystal display (LCD), the method comprising:

providing a plurality of groups of transistors arranged in rows and columns which form a pixel array of said LCD;

providing a plurality of backlight units arranged in rows and columns which form a backlight panel of said LCD, wherein the backlight units are independently controllable;

periodically refreshing data at the groups of transistors, wherein the data is being refreshed at a specified data refresh order and at a specified refresh rate over a specified period; and periodically dimming the backlight units at said specified data refresh order and at a specified dimming rate over said specified period, to backlight the one or more of the transistor groups only whenever the data at said transistor groups is not being refreshed, wherein the LCD is a micro display integrated within a head mounted display (HMD), and operating in a dim-to-refresh ratio in which the specified backlight dimming rate is between 3 times to 10 times higher than the specified refresh rate, and wherein said operating in the dim-to-refresh ratio eliminates a smearing of an image projected from the micro display over a retina of an eye of a viewer wearing the HMD, whenever a head of the viewer is moving, wherein the dimming is carried out independently at variable levels so that some of the backlight units are dimmed more or less than others during said specified period.

8. The method according to claim 7, wherein the backlight control module is further configured to selectively dim backlight units that are located along borders of the LCD.

9. The method according to claim 7, wherein the data refreshing is carried out in a predefined refreshing pattern which sets out an order of refreshing the pixels and wherein the dimming is carried out in a predefined dimming pattern which sets out an order of dimming the backlight units, and wherein the refreshing pattern and the dimming pattern are synchronized so that the dimming pattern follows the refreshing pattern.

10. The method according to claim 7, wherein the dimming comprises switching off at least one backlight unit.

11. The method according to claim 7, wherein at least one of the transistors groups include one or more transistors.

12. The method according to claim 7, wherein said LCD comprises M transistors groups and N backlight units and wherein N<M.

* * * * *